US008016682B2

(12) United States Patent
Stephenson, III et al.

(10) Patent No.: US 8,016,682 B2
(45) Date of Patent: Sep. 13, 2011

(54) QUICK CHANGE GLASS MOUNTING ARRANGEMENT FOR GAMING CABINET

(75) Inventors: Orlando W. Stephenson, III, Kentwood, MI (US); Ryan D. McComb, Grand Rapids, MI (US); Brian M. Anderson, Grand Rapids, MI (US); David J. Looks, Grand Rapids, MI (US)

(73) Assignee: SPEC International, Grand Rapids, MI (US)

( * ) Notice: Subject to any disclaimer, the term of this patent is extended or adjusted under 35 U.S.C. 154(b) by 1109 days.

(21) Appl. No.: 11/749,995

(22) Filed: May 17, 2007

(65) Prior Publication Data

US 2008/0045347 A1 Feb. 21, 2008

Related U.S. Application Data

(60) Provisional application No. 60/831,506, filed on Jul. 18, 2006.

(51) Int. Cl.
*A63F 11/00* (2006.01)

(52) U.S. Cl. ..... 463/46; 463/20; 463/45; 463/47

(58) Field of Classification Search ..... 463/20, 463/45, 46, 47
See application file for complete search history.

(56) References Cited

U.S. PATENT DOCUMENTS

| | | | | |
|---|---|---|---|---|
| 5,638,906 | A * | 6/1997 | McCabe | 169/51 |
| 6,164,098 | A * | 12/2000 | Hommes | 70/78 |
| 6,475,087 | B1 * | 11/2002 | Cole | 463/20 |
| 2005/0288097 | A1 * | 12/2005 | Rasmussen | 463/30 |
| 2006/0100014 | A1 * | 5/2006 | Griswold et al. | 463/31 |
| 2007/0238531 | A1 * | 10/2007 | Taxon | 463/46 |

* cited by examiner

*Primary Examiner* — Dmitry Suhol
*Assistant Examiner* — Brandon Gray
(74) *Attorney, Agent, or Firm* — Price Heneveld LLP

(57) ABSTRACT

A mounting arrangement for supporting the light-transmitting sheets of material in a gaming cabinet includes an upper retaining structure that secures an upper edge of the sheet, and a lower support surface upon which a lower edge portion of the sheet is disposed. A retaining bracket or the like secures at least the lower portion of the sheet of material to the gaming cabinet.

32 Claims, 6 Drawing Sheets

QUICK CHANGE GLASS MOUNTING ARRANGEMENT FOR GAMING CABINET

CROSS-REFERENCE TO RELATED APPLICATIONS

This application claims the benefit of U.S. Provisional Application No. 60/831,506, filed Jul. 18, 2006, the entire contents of which is hereby incorporated by reference.

BACKGROUND OF THE INVENTION

Gaming machines for casinos and the like typically include a cabinet having an interior space which houses the various game components, electronics, and the like, and an open front side that can be closed off by a door to prevent access to the interior space by unauthorized persons. Such cabinet doors often include features for mounting bill acceptors, coin/token dispensers, and the like, as well as a panel having various features for control of the game such as buttons, levers, and the like.

Gaming machines often include an enlarged opening on a front side of the cabinet that may be through the cabinet door. The enlarged opening provides visual access to a display screen, reels, or other visual elements of the game positioned inside the cabinet and/or on the cabinet door. Such openings are typically closed off by a sheet of glass or other suitable light-transmitting material. The sheet may include designs, images, messages, and the like to create an attractive appearance for the game and provide prospective players of the game with information concerning the type of game provided by the gaming machine, and/or provide a player with information for playing the game.

One type of gaming machine includes an upright cabinet that is generally configured for use by a player who is either standing or sitting on a relatively tall stool or chair. Such gaming cabinets often include a door cm the front side of the cabinet that, when closed, extends across the entire front side of the cabinet, or a substantial portion thereof. The door pivots about a vertical axis to open and close the door. Such gaming cabinets may include one or more enlarged upper openings through the door providing visual access to the internal game components. Versions having two enlarged openings typically include a horizontal cross member that extends across the door between the upper and lower openings. Each opening is closed off by a sheet of glass or the like, and each sheet has images, designs, and the like corresponding to the particular game that the cabinet is configured for.

Another type of gaming machine includes a somewhat shorter cabinet configured for play by a seated player. Such games typically include at least one enlarged opening on the front side of the cabinet that is covered by a sheet of light-transmitting material to provide visual access to the internal game components. The openings in cabinets for games of this type may be formed in a panel or door that only forms a portion of the front side of the cabinet. Such doors may be mounted to pivot outwardly and downwardly about a horizontal axis, or the door may pivot outwardly about a vertical axis.

Because newer games often attract more players, it is often desirable to introduce new games on a regular basis. Because replacement of the entire gaming machine is relatively expensive, various gaming components are often removed from an existing cabinet, and replaced with new components to thereby convert the gaming cabinet to the new game. The glass sheets on the front of the game are often changed to provide new graphics, images, and the like corresponding to the new game for which the cabinet is being used.

However, replacing the glass is often difficult and time consuming, thereby increasing the cost of retrofitting the cabinets due to the labor involved, and the additional down time of the gaming machine.

Accordingly, a way to alleviate the drawbacks of existing glass mounting arrangements for gaming machines would be desirable.

SUMMARY OF THE INVENTION

One aspect of the present invention is a gaming machine having a cabinet defining an internal space for mounting various gaming components. The cabinet includes an enlarged opening on a front side of the cabinet that provides visual access to game features such as a display screen, reels, or the like. The cabinet includes upper and lower support structures configured to support a sheet of glass or other light-transmitting material across the enlarged opening. During installation, an upper edge of the sheet may be brought into engagement with the upper support structure, and the lower edge of the sheet of material is then rotated towards the cabinet opening. The lower edge of the sheet of glass is then positioned on an upwardly-facing support surface of the lower support structure. A retaining member is then secured to the cabinet to retain the glass to the cabinet.

The upper support structure preferably includes a downwardly-opening channel that loosely receives an upper edge of the sheet of glass to permit insertion of the upper edge into the channel with the bottom edge of the glass spaced-apart from the cabinet opening. The lower support structure may include a flange that projects inwardly adjacent a lower edge of the cabinet opening to support the glass when it is brought into position across the opening. The retaining member may be in the form of a bracket having a picture frame-like shape extending around the perimeter of the sheet of glass.

The gaming cabinet may include a door forming a substantial portion of the front side of the cabinet, with the enlarged opening being formed in the door. Alternately, the enlarged opening may be formed through a fixed panel of the gaming cabinet that does not pivot to form a door.

The gaming cabinet may include first and second sheets of glass or other light-transmitting material covering a pair of vertically juxtaposed openings on a front side of the cabinet. An upper edge of the upper sheet of glass is retained in a downwardly-opening channel, and a lower edge of the upper sheet of glass is supported on a support surface of a horizontally-extending cross member between the upper and lower sheets of glass. An upper edge of the lower sheet of glass is retained in a downwardly-opening channel in the horizontally-extending cross member, and the lower edge of the lower sheet of glass is supported on an upwardly facing support surface adjacent the lower edge of the lower opening. A retaining member or members retain the lower edges of the upper sheet of glass and the lower sheet of glass. A lower edge of the retaining member is pivotably supported on one or more stand-offs, and an upper portion of the retaining member is secured to the cabinet by threaded fasteners or other suitable connectors. The upper and lower openings may be formed in a door that closes off substantially the entire front side of the gaming cabinet.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
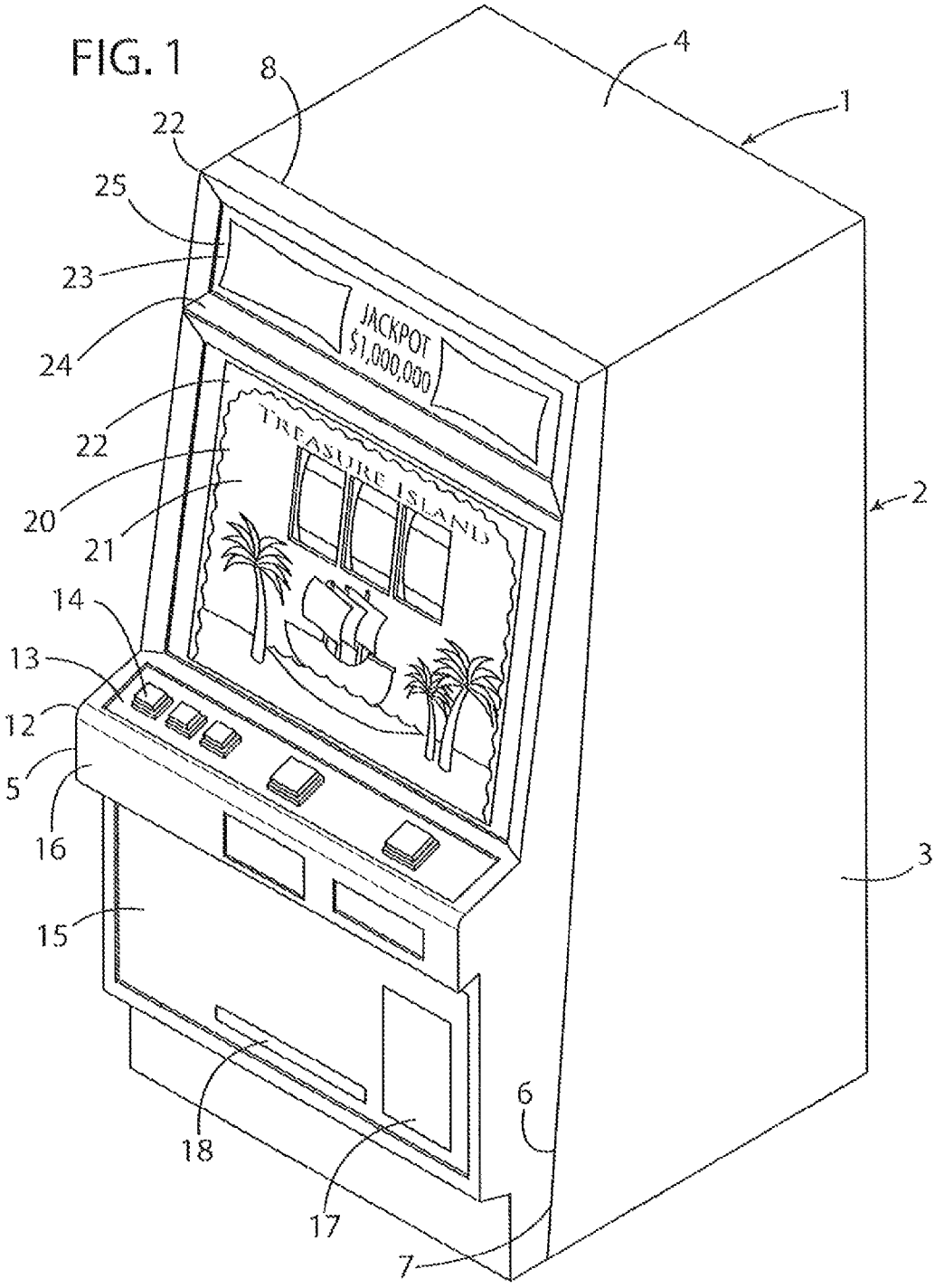
FIG. 1 is an isometric view of a gaming machine according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference, to FIG. 1, a gaming machine 1 includes a cabinet 2 having vertical side panels 3, an upper panel 4, and a door 5 that is pivotably mounted to the cabinet for movement between open and closed positions. Cabinet 2 has an enlarged opening 6 on the front side with a perimeter that is generally formed by side edges 7 and 8 of side panels 3 and 4, respectively. In the illustrated example, the opening 6 is substantially coextensive with the front side of cabinet 2. However, it will be understood that opening 6 may not extend across the entire front side of cabinet 2 if required for a particular application.

Door 5 includes a forwardly-projecting portion 12 having an upwardly-facing panel portion 13 having one or more game control features such as push buttons 14. A generally vertical lower panel 15 is offset inwardly from the outer surface 16 of forwardly-protruding portion 12. A bill acceptor 17 and coin/token dispenser 18 may be mounted to the lower panel 15.

Door 5 includes an enlarged opening 20, and a sheet of glass 21 or other light-transmitting material extends across opening 20. Various graphic material 22 on glass 21 includes images relating to the game, messages, and the like that provide visual interest, and convey information to prospective game players concerning the game play or theme. Door 5 may include an upper opening 23 and a horizontal cross member 24 extending between upper opening 23 and opening 20. An upper sheet of glass or other light-transmitting material 25 may also include graphics 22 and the like relating to the game.

Figure 2:
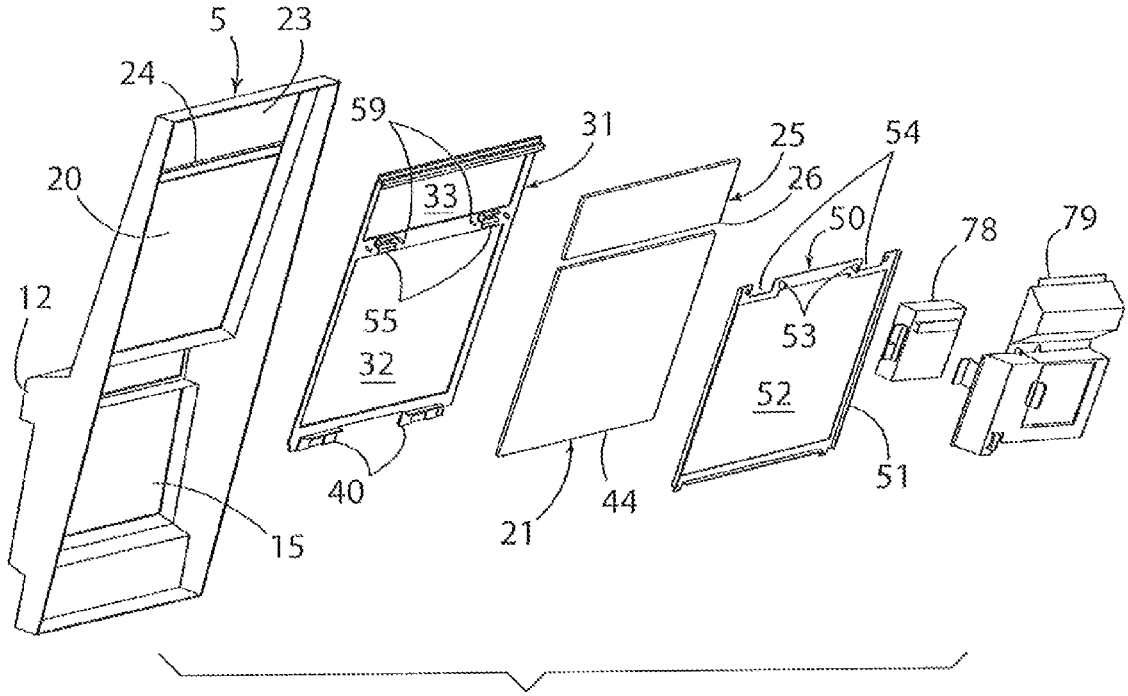
FIG. 2 is a partially fragmentary, exploded isometric view of a portion of the gaming cabinet of FIG. 1.
Figure 3:
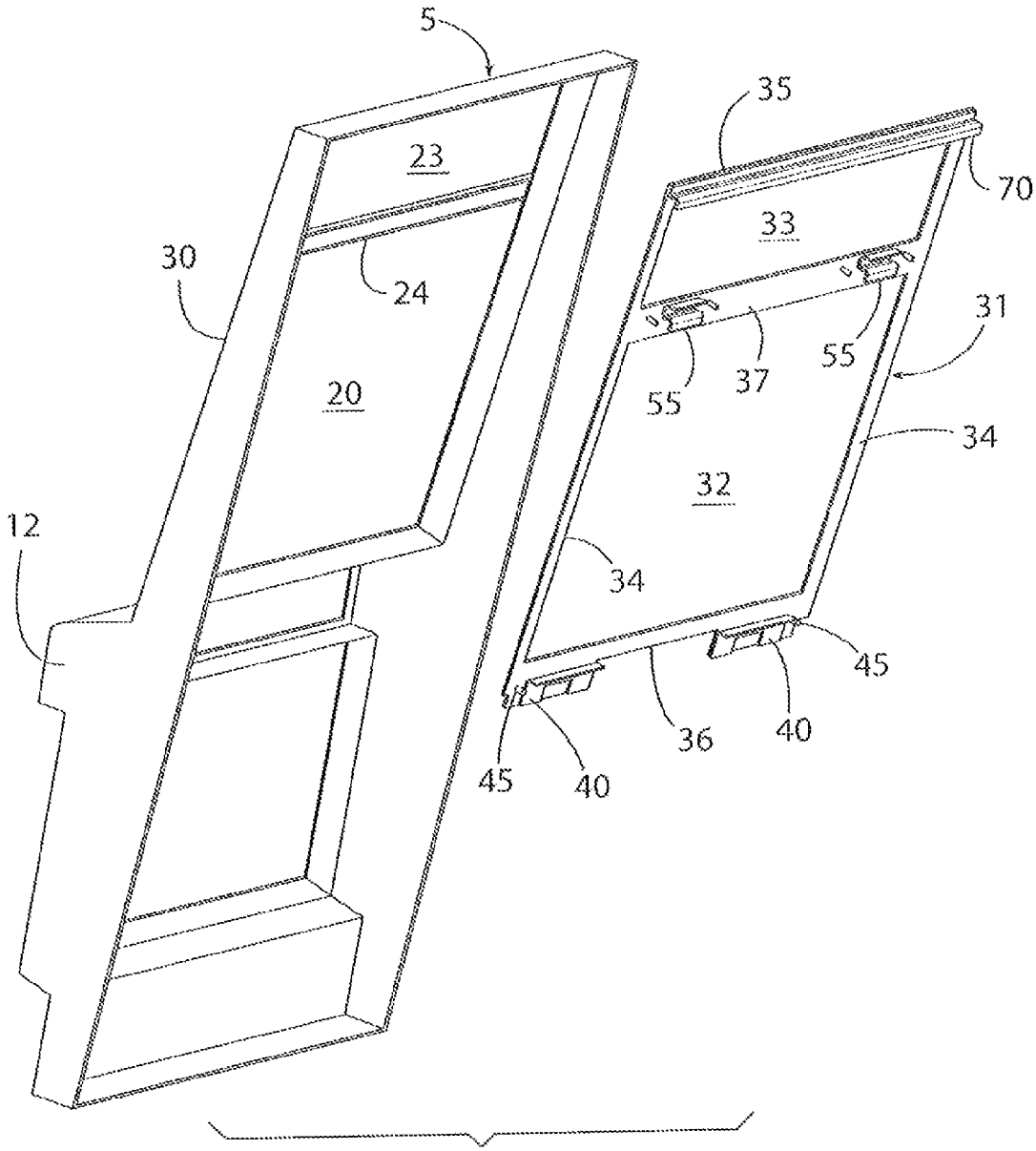
FIG. 3 is an exploded isometric view showing the outer door structure, and inner window-mounting structure.

With further reference to FIGS. 2 and 3, door 5 includes an outer structure 30 and an inner bracket structure 31. Inner bracket structure 31 includes an enlarged lower opening 32 that is approximately the same size as enlarged opening 20 in door 5 in the illustrated example. As described in more detail below, inner bracket structure 31 is secured to outer door structure 30, and a retaining bracket 50 attaches to inner bracket structure 31 to retain glass sheets 21 and 25 to the door 5. Inner bracket structure 31 also includes an upper opening 33 that is about the same size as opening 23 of outer door structure 30. Inner bracket structure 31 includes vertically extending side portions 34, a horizontally extending upper portion 35, and a horizontally extending lower portion 36 forming a perimeter of inner bracket structure 31 that is generally quadrilateral in shape. A horizontally extending intermediate portion 37 extends between vertical side portions 34. During assembly, inner bracket structure 31 is secured to the outer frame structure 30 by welding, threaded fasteners, or other suitable arrangement. When the inner bracket structure 31 is secured to outer door structure 30, upper openings 23 and 33 are generally aligned, as are lower openings 20 and 32 of outer door structure 30 and inner bracket structure 31, respectively.

Figure 4:
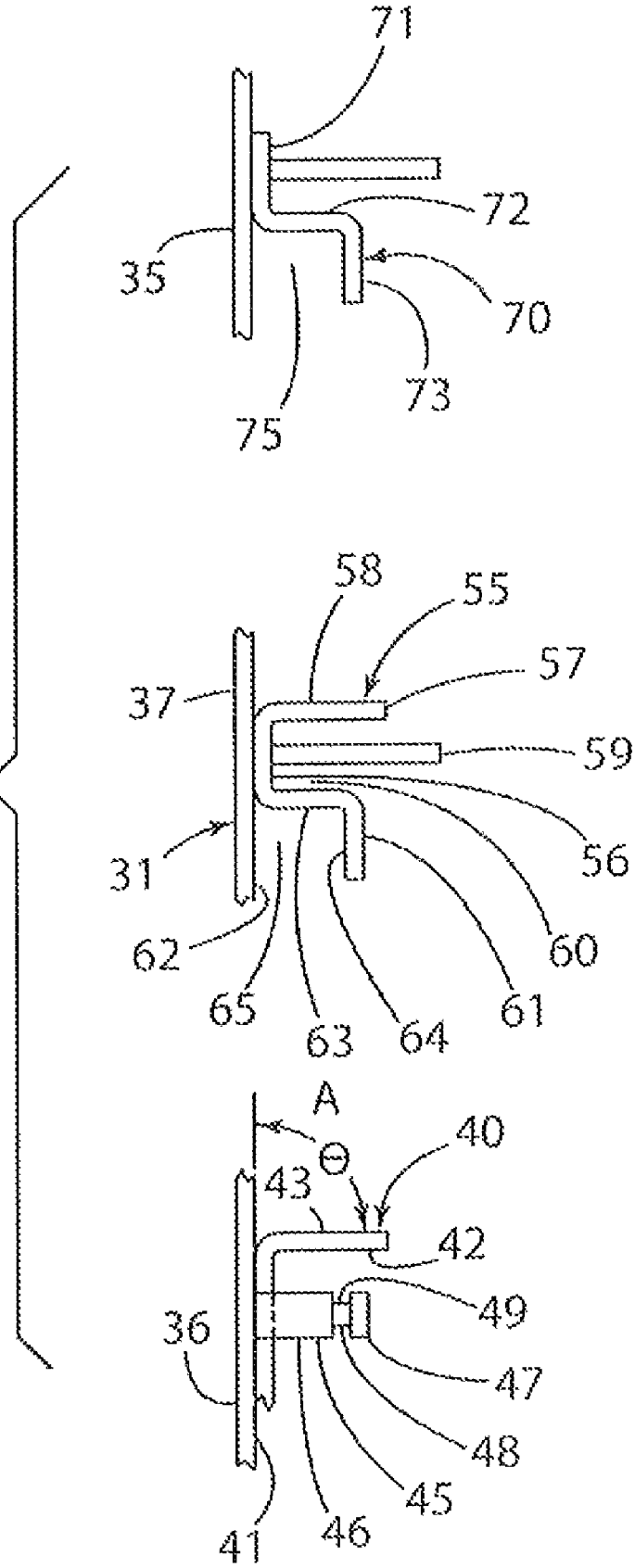
FIG. 4 is a partially fragmentary edge view of a portion of the door showing the glass support features.

A pair of lower support brackets 40 are secured to lower portion 36 of inner bracket structure 31 utilizing threaded fasteners, welding, or other suitable arrangement. Alternately, the lower support brackets may be formed integrally with the inner bracket structure 31. With further reference to FIG. 4, lower support brackets 40 include a generally vertical flange 41 that abuts lower portion 36 of inner bracket structure 30. Lower support brackets 40 also include an outwardly extending flange 42 forming an upwardly lacing support surface 43. The outwardly extending flange 42 may extend orthogonal relative to horizontal lower portion 36, such that support surface 43 is horizontal. Alternately, flange 42 may extend upwardly somewhat at an angle forming an angle θ relative to a vertical plane "A" that is less than 90°. As described in more detail below, lower edge 44 (FIG. 2) of glass 21 contacts support surface 43. If an angle θ (FIG. 4) is less than 90°, the upwardly-facing support surface 43 will tend to retain lower edge 44 of glass 21 against horizontal lower portion 36 of inner bracket structure 31. A stand-off 45 extends from horizontal lower portion 36 of inner bracket structure 31. Stand-off 45 has a base portion 46, an end portion 47 and an intermediate portion 48. The base portion 46, end portion 47 and intermediate portion 48 have circular cross-sectional shapes, and intermediate portion 48 has a reduced diameter to form a support surface 49. As described in more detail below, stand-off 45 pivotably supports a lower portion of retaining bracket 50.

Inner bracket structure 31 further includes a pair of "Z" brackets 55 that are mounted to intermediate portion 37 of inner bracket structure 31. Z brackets 55 include a base web portion 56 that is secured to intermediate portion 37 of inner bracket structure by welding, threaded fasteners, or other suitable arrangement. A support flange 57 extends outwardly away from base web 56, and forms a support surface 58. Support flange 57 may extend orthogonal relative to vertical plane A, or it may extend upwardly at an angle that, is less than 90°. As discussed in more detail below, when installed, lower edge 26 (FIG. 2) of upper glass 25 contacts support surface 58. Flange 57 may extend upwardly somewhat to create an angled support surface 58 that tends to retain lower edge 26 of glass sheet 25. Z brackets 55 also include a web 60 that extends away from base web 56, with an end portion 61 that extends downwardly. The inner surface 62 of intermediate portion 37 of inner bracket structure 31, lower surface 63 of web 60, and inner surface 64 of end portion 61 of web 60 together define a downwardly-opening channel 65. As described in more detail below, threaded studs 59 threadably connect an upper portion of retaining bracket 50 to inner bracket structure 31.

An upper bracket 70 includes a base web 71 that is secured to upper portion 35 of inner bracket structure 31 by welding or the like, an outwardly extending web 72, and a downwardly extending end portion 73. Bracket 70 and horizontal upper portion 35 of inner bracket structure 31 define a second downwardly-opening channel 75. In the illustrated example, upper bracket 70 extends along the entire upper portion 35 of inner bracket structure 31. However, it will be understood that upper bracket 70 could extend less than the entire width, or it could comprise two spaced-apart members.

Figure 5:
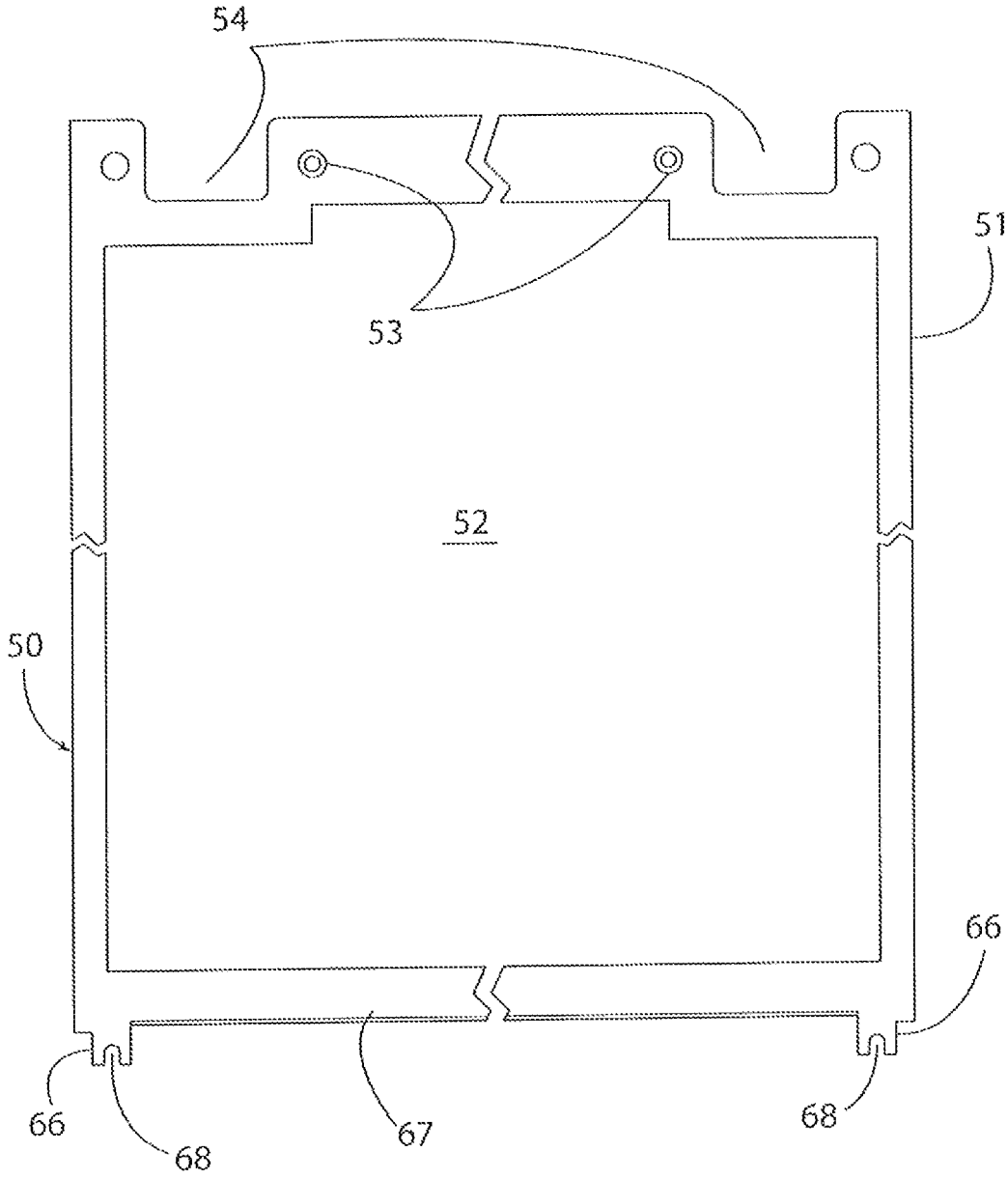
FIG. 5 is a fragmentary view of the retaining bracket.

With reference back to FIGS. 2 and 5, retaining bracket 50 includes a perimeter frame 51 having a generally quadrilateral shape, and an enlarged central opening 52 that is also generally quadrilateral in shape. A pair of threaded members 53 are rotatably connected to retaining bracket 50 to threadably engage threaded studs 59 (FIG. 4). Retaining bracket 50 also includes cutouts 54 to provide clearance for Z brackets 55. Housings 78 and 79 provide for mounting of lights and other associated components that provides lighting and/or other visual effects that are visible through the light-transmitting sheet 20 and/or 23.

Referring again to FIG. 5, retainer bracket 50 includes a pair of downwardly extending tabs 66 at a bottom portion 67 of retaining bracket 50. Each tab 66 includes a downwardly-opening slot 68. As discussed in more detail below, slots 68 engage stand-offs 45 (FIG. 4) to support and/or retain bracket 50 to inner bracket structure 31.

Figure 6:
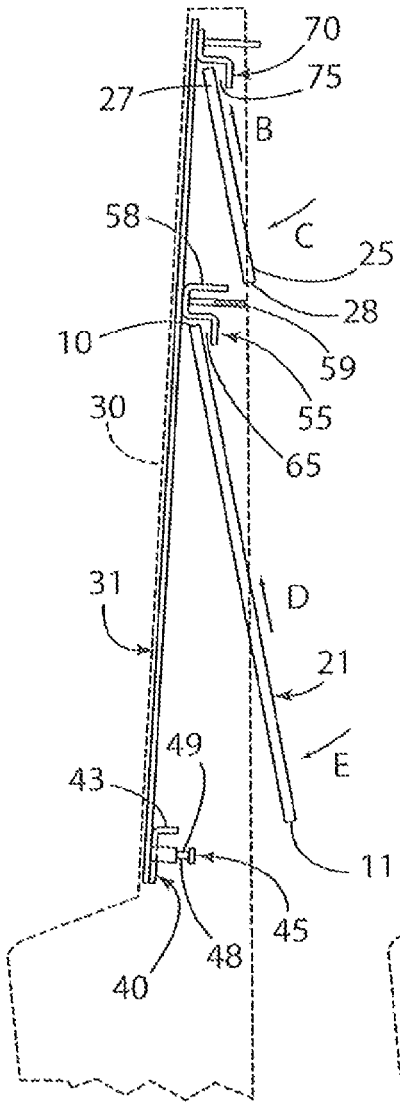
FIG. 6 is a partially schematic view of the glass being installed.
Figure 7:
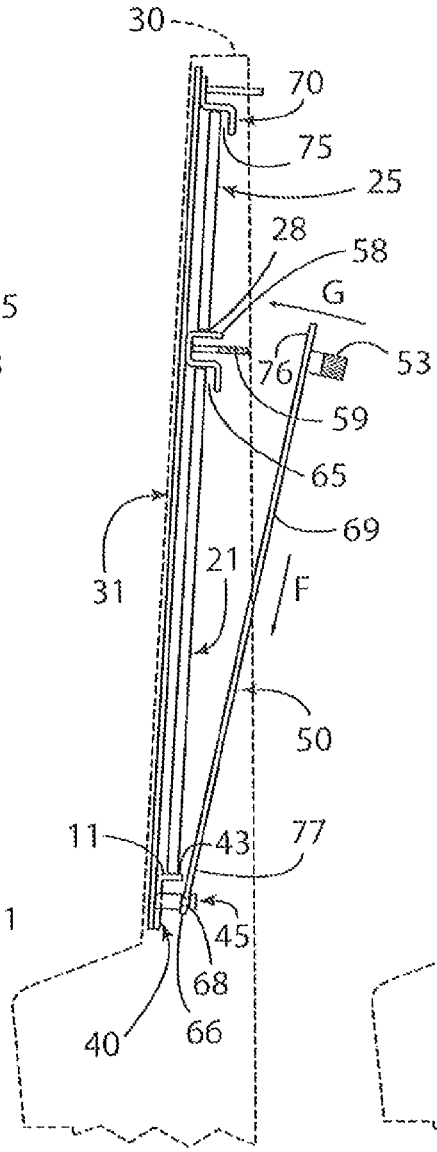
FIG. 7 is a partially schematic view of the glass being installed.
Figure 8:
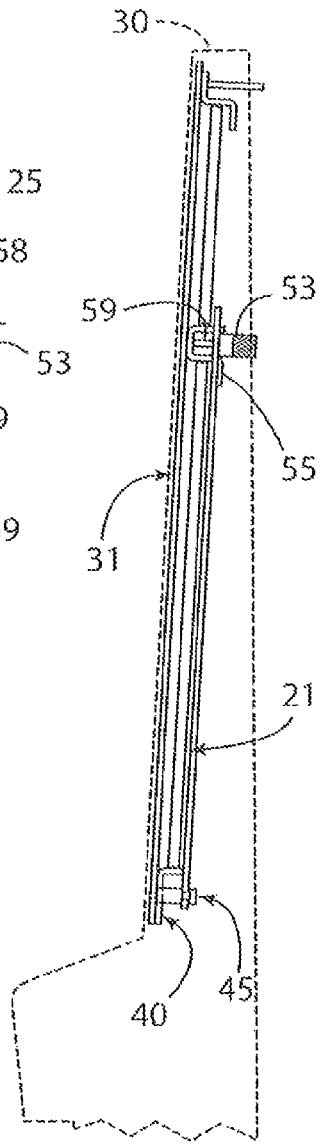
FIG. 8 is a partially schematic view showing the glass in the installed configuration.

With further reference to FIG. 6, during installation of light-transmitting sheets 21 and 25, upper edge portion 27 of upper light-transmitting sheet 25 is inserted into channel 75 of bracket 70, and the sheet 25 is shifted upwardly in the direction of the arrow "B". The lower edge portion 28 of sheet 25 is then shifted inwardly by rotating the sheet 25 about upper edge portion 27 in the direction of the arrow "C", and the lower edge is brought downwardly into contact with upwardly facing support surface 58 of bracket 55 as shown in FIG. 7. Similarly, tipper edge portion 10 of sheet 21 is inserted in channel 65 of bracket 55 by shifting sheet 21 in the direction of the arrow "D". Lower edge portion 11 of sheet 21 is then moved inwardly in the direction of the arrow "E" by rotating sheet 21 about edge portion 10 until sheet 21 is above support surface 43 of bracket 40. Sheet 21 is then shifted downwardly such that lower edge portion 11 rests on support surface 43 of bracket 40 as shown in FIG. 7. Retaining bracket 50 is then engaged with stand-offs 45 by positioning reduced diameter intermediate portion 48 of stand-offs 45 in slots 68 of tabs 66 (see also FIG. 5) as illustrated by the arrow "F". Upper portion 69 of retaining bracket 50 is then moved inwardly as shown by the arrow "G" by rotating bracket 50 about stand-offs 45. Threaded connectors 53 are then threadably secured to threaded studs 59 to secure retaining bracket 50 to inner bracket structure 31. With further reference to FIG. 8, when retaining bracket 50 is in the installed position, upper portion 76 of retaining bracket 50 extends over lower edge portion 28 of sheet 25 to thereby retain sheet 25 to inner bracket structure 31, and lower portion 77 of retaining bracket 50 similarly retains lower edge portion 11 of sheet 21. Although a variety of different connecting arrangements could be utilized, in the illustrated example the threaded connector 53 is a commercially available connector having a fixed base, and a knurled portion that is biased outwardly by a spring and pushed inwardly and rotated by hand to threadably engage threaded studs 59.

When the sheets of light-transmitting material 21 and 25 are in the installed configuration shown in FIG. 8, the upper edge portions of the sheets 21 and 25 are retained by channels 65 and 75, respectively, and the lower edge portion of sheets 21 and 25 are retained by retaining bracket 50. The glass sheets 21 and/or 25 can be quickly and easily removed and/or replaced by reversing the installation procedure described above in connection with FIGS. 6 and 7. The glass retaining arrangement of the present invention permits installation and/or removal of glass sheets from a gaming cabinet without use of tools or the like. This arrangement provides a substantial reduction in the amount of time required for a installation and removal of glass or other light-transmitting sheets of gaming machines.

Although the example described above shows two sheets of glass installed on a door of a gaming machine, it will be readily apparent that light-transmitting sheets may be mounted to other portions of gaming cabinets other than the door. Also, a single sheet of glass may be secured to a door or other portion of a gaming cabinet utilizing substantially the same arrangement, wherein an upper edge of the sheet is retained by opposed surfaces, a lower portion of the sheet is rotated towards the opening in the cabinet, and the lower edge of the sheet is then rested on a support surface. The lower portion of the sheet may then be secured to the cabinet by use of a retaining member, bracket, or the like.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A gaming machine, comprising:

a cabinet structure having generally upright sidewalls and connecting structure extending between and interconnecting the sidewalls, wherein the cabinet defines an internal space and a front opening providing access to the internal space;

a door movably mounted to the cabinet structure, wherein the door is movable between a closed position closing off at least a portion of the front opening, and an open position providing access to the internal space through the front opening, the door having at least one enlarged door opening therethrough defining upper and lower edges, the door including an upper retaining structure having a downwardly-opening portion that is generally U-shaped, the door further including at least one upwardly-facing support surface adjacent the lower edge of the door opening;

an electronic game controller positioned in the internal space of the cabinet;

at least one game display device operably connected to the electronic game control;

at least one game input device operably connected to the game controller and mounted to the gaming machine at a position where the input device can be manipulated by a user to provide for game play;

a sheet of light-transmitting material defining upper and lower portions, upper and lower edges, the sheet of light-transmitting material extending across at least a substantial portion of the door opening;

a retaining member configured to be attached to the door;

whereby the sheet of light-transmitting material can be installed to the door by inserting the upper edge of the light-transmitting sheet into the U-shaped portion of the upper retaining structure, and shifting the lower edge of the light-transmitting sheet towards the door and positioning the lower edge of the light-transmitting sheet on the support surface, and positioning the retaining member so it retains the lower portion of the light-transmitting sheet to the door while the upper retaining structure retains the upper portion of the light-transmitting sheet to the door such that the game display device is at least partially visible through the light-transmitting sheet.

2. The gaming machine of claim 1, wherein:

the sheet of light-transmitting material comprises a lower sheet of light-transmitting material, and the U-shaped portion comprises a first -shaped portion, and the upwardly facing support surface comprises a first upwardly facing support surface, and the enlarged door opening comprises a lower door opening, and the door includes an upper door opening above the lower door opening, and including:

a second sheet of light-transmitting material extending across at least a substantial portion of the upper door opening;

a second downwardly opening U-shaped portion adjacent an upper edge of the upper door opening;

a second upwardly facing support surface adjacent a lower edge of the upper door opening;

whereby an upper edge of the second sheet of light-transmitting material can be received in the second downwardly opening U-shaped portion and a lower edge of the second sheet of light-transmitting material can be supported on the second upwardly facing support surface.

3. The gaming machine of claim 2, wherein:

a portion of the retaining member extends along a lower portion of the second sheet of light-transmitting material and retains a lower edge of the second of light-transmitting material on the second upwardly facing support surface.

4. The gaming machine of claim 3, wherein:

the retaining member comprises an enlarged bracket having horizontally spaced-apart vertically extending side members and vertically spaced-apart horizontally extending upper and lower members forming an enlarged opening that is aligned with the lower door opening.

5. The gaming machine of claim 4, wherein:

the enlarged bracket has a generally quadrilateral perimeter, and the enlarged opening has a generally quadrilateral shape formed by inner surfaces of the side members and the upper and lower members.

6. The gaming machine of claim 1, wherein:

the U-shaped portion of the upper retaining structure comprises an elongated bracket having a downwardly-opening channel that is generally U-shaped in cross section.

7. The gaming machine of claim 1, wherein:

the door includes at least one stand-off structure adjacent a lower portion of the door opening; and the retaining member includes at least one connector configured to engage the stand-off structure and support the retaining member on the door.

8. The gaming machine of claim 7, wherein:

the stand-off structure extends inwardly towards the internal space, and includes an upwardly-opening U-shaped portion; and a lower edge portion of the retaining member is received in the U-shaped portion to substantially prevent movement of the lower edge portion towards and away from the door.

9. The gaming machine of claim 8, wherein:

the stand-off structure has a generally circular cross-sectional shape with an end portion having a first diameter, and a portion having a reduced diameter relative to the first diameter forming the upwardly-opening U-shaped portion.

10. The gaming machine of claim 9, wherein:

the lower edge portion of the retaining member comprises a downwardly-opening slot having a width that is less than the first diameter to thereby substantially prevent movement of the lower edge portion of the retaining member away from the door when the reduced diameter portion of the stand-off structure is received in the slot.

11. The gaming machine of claim 10, wherein:

the retaining member can be rotated about the stand-off structure to shift an upper portion of the retaining member towards the door.

12. The gaming machine of claim 1, wherein:

the door includes at least one threaded stud adjacent an upper edge of the enlarged door opening, the retaining member having a threaded member rotatably mounted to the retaining member and threadably engaging the threaded stud.

13. The gaming machine of claim 1, wherein:

the upwardly-facing support surface is substantially horizontal.

14. The gaming machine of claim 13, wherein:

the door includes a pair of spaced-apart brackets, each defining an upwardly-facing support surface.

15. The gaming machine of claim 1, wherein:

the door includes at least one inwardly-extending stand-off structure adjacent a lower portion of the enlarged door opening, wherein the stand-off structure is at a lower height of the door than the upwardly-facing support surface.

16. The gaming machine of claim 1, wherein:

the door includes a primary outer structure having an enlarged opening therethrough, and an inner bracket structure secured to the primary outer structure, the inner bracket structure having an enlarged opening therethrough aligned with at least a portion of the enlarged opening of the primary outer structure, and wherein the upper retaining structure and the upwardly-facing support surface are formed by the inner bracket structure.

17. The gaming machine of claim 16, wherein:

the enlarged opening through the inner bracket structure comprises a lower opening, the inner bracket structure including an upper opening above the lower opening and a horizontal divider extending across the inner bracket structure between the upper and lower openings, the sheet of light-transmitting material comprising a lower sheet of light-transmitting material, and including:

a second sheet of light-transmitting material extending across the upper opening.

18. The gaming machine of claim 17, wherein:

the upper retaining structure is positioned on the horizontal divider, the inner bracket structure further including an intermediate support surface, the door including a top retaining structure having a downwardly-opening U-shaped portion, an upper edge of the upper light-transmitting sheet disposed in the U-shaped portion of the top bracket.

19. The gaming machine of claim 18, including:

a bracket on an inner side of the horizontal divider, the bracket including an upper flange that extends inwardly to form the intermediate support surface, and a lower flange having a first portion that extends inwardly, and a second portion that extends downwardly, and wherein the lower flange and a portion of the horizontal divider form the downwardly-opening portion of the upper retaining structure.

20. A cabinet for gaming machines of the type having a controller, a game display feature, and an input device permitting input by a user of the gaming machine, the cabinet comprising:

a cabinet defining an interior space suitable for receiving gaming components, the cabinet having an enlarged opening providing access to the interior space;

a door movably mounted to the cabinet and selectively closing off the enlarged opening when in a closed position, the door having an enlarged opening therethrough and a forwardly-projecting portion below the enlarged opening having an upwardly facing game control area configured to receive game control input features that can be manipulated by a player to affect game play, and an outer end portion, the door further including a generally vertical lower panel below the forwardly-projecting portion that is offset inwardly from the outer end portion of the forwardly-projecting portion, the lower panel including at least one opening therethrough and associated mounting structure that provides for mounting of at least one of a bill acceptor and a currency dispenser;

the door further including an upper support structure having horizontally spaced-apart retaining surfaces, and a lower support structure having an upwardly-facing lower support surface;

a sheet of light-transmitting material extending across at least a substantial portion of the enlarged opening through the door, the sheet having a first edge portion received between the horizontally spaced-apart retaining surfaces to retain an upper portion of the sheet of light-transmitting material to the door by limiting movement of the upper portion of the sheet relative to the door, yet permitting rotation of the sheet about the first edge portion, the sheet having a second edge abuttingly engaging the upwardly-facing lower support surface to support the sheet;

a retaining member connected to the door and retaining a lower portion of the sheet by substantially preventing shifting of a lower portion of the sheet away from the door.

21. The cabinet for gaming machines of claim 20, wherein:

the upper support structure comprises a downwardly-opening U-shaped member defining the horizontally spaced-apart retaining surfaces.

22. The cabinet for gaming machines of claim 21, wherein:

the U-shaped member includes an elongated channel;

the first edge portion of the light-transmitting sheet comprises a horizontal upper edge portion that is disposed in the elongated channel.

23. The cabinet for gaming machines of claim 20, wherein:

the lower support structure comprises a horizontally-extending flange.

24. The cabinet for gaming machines of claim 20, wherein:

the retaining member is removably connected to the door.

25. The cabinet for gaming machines of claim 24, wherein:

the door includes at least one inwardly-extending stand-off structure, and a lower edge portion of the retaining member abuttingly engages an upwardly-facing surface of the stand-off structure.

26. The cabinet for gaming machines of claim 25, wherein:

the stand-off structure includes horizontally spaced-apart opposed surfaces directly adjacent the upwardly-facing surface of the stand-off structure, and a portion of the retaining member is disposed between the opposed surfaces.

27. The cabinet for gaming machines of claim 24, wherein:

the retaining member has a generally quadrilateral perimeter and an enlarged quadrilateral central opening, and wherein a lower edge portion of the retaining member is pivotably supported by the door, such that an upper portion of the retaining member can be rotated inwardly towards the door during assembly; and including:

at least one connector securing an upper portion of the retaining member to the door.

28. A method of securing a light-transmitting sheet of material to a gaming machine cabinet of the type having an interior space in which a game controller is mounted, and an enlarged opening through a front side of the cabinet through which a player can view visual features of the game, the front side further including game input features permitting a player to affect game play, the method comprising:

providing an upper retaining structure on an interior side of the gaming machine cabinet adjacent an upper edge of the enlarged opening;

providing a lower support structure adjacent a lower edge of the enlarged opening;

providing a sheet of light-transmitting material;

bringing a lower edge of the sheet of light-transmitting material into pivotable engagement with the lower support structure;

rotating an upper portion of the sheet of light-transmitting sheet of material towards the enlarged opening;

positioning the sheet of light-transmitting material such that it extends across at least a substantial portion of the enlarged opening through the front side of the gaming machine cabinet; and securing at least an upper portion of the sheet to the gaming machine cabinet whereby a player can view visual features of the game through the light-transmitting sheet.

29. The method of claim 28, wherein:

the gaming machine cabinet includes a door, and the enlarged opening is formed in the door; and including:

pivotably mounting the door to the gaming machine cabinet.

30. The method of claim 28, including:

supplying a retaining member; and connecting the retaining member to the gaming machine cabinet to retain at least a lower portion of the sheet of light-transmitting material to the door.

31. The method of claim 30, including:

rotatably engaging a lower edge of the retaining member with the gaming machine cabinet;

rotating an upper portion of the retaining member towards the gaming machine cabinet; and securing the retaining member to the gaming machine cabinet to thereby retain the sheet of light-transmitting material to the cabinet.

32. A gaming machine, comprising:

a cabinet structure having generally upright sidewalls and connecting structure extending between and interconnecting the sidewalls, wherein the cabinet defines an internal space and a front opening providing access to the internal space;

a door movably mounted to the cabinet structure, wherein the door is movable between a closed position closing off at least a portion of the front opening, and an open position providing access to the internal space through the front opening, the door having at least one enlarged door opening therethrough defining upper and lower edges, the door including an upper retaining structure fixed to the door, the upper retaining structure having a downwardly-opening portion that is generally U-shaped to define a gap having a gap dimension across the gap, the door further including at least one upwardly-facing support surface adjacent the lower edge of the door opening;

an electronic game controller positioned in the internal space of the cabinet;

at least one game display device operably connected to the electronic game control;

at least one game input device operably connected to the game controller and mounted to the gaming machine at a position where the input device can be manipulated by a user to provide for game play;

a sheet of light-transmitting material defining upper and lower portions, upper and lower edges, the sheet of light-transmitting material extending across at least a substantial portion of the door opening, the sheet defining a thickness at the upper edge that is significantly less than the gap dimension whereby the sheet of light-transmitting material can be rotated about a generally horizontal axis about the upper edge after the upper edge is inserted into the gap defined by the upper retaining structure;

a retaining member configured to be detachably attached to the door;

whereby the sheet of light-transmitting material can be installed to the door by inserting the upper edge of the light-transmitting sheet into the U-shaped portion of the upper retaining structure, and shifting the lower edge of the light-transmitting sheet towards the door by rotating the sheet of light-transmitting material about the upper edge thereof and positioning the lower edge of the light-transmitting sheet on the support surface, and positioning the retaining member so it retains the lower portion of the light-transmitting sheet to the door while the upper retaining structure retains the upper portion of the light-transmitting sheet to the door such that the game display device is at least partially visible through the light-transmitting sheet.

* * * * *